US005455980A

United States Patent [19]

Buchanan

[11] Patent Number: 5,455,980

[45] Date of Patent: Oct. 10, 1995

[54] MOP INCLUDING A FRAME BLOCK HOLDER WITH A REMOVABLE TUBE-SHAPED COVER

[76] Inventor: Ritchie Buchanan, 10 Hillside Dr., North Hampton, N.H. 03862

[21] Appl. No.: 245,953

[22] Filed: Jun. 28, 1994

[51] Int. Cl.[6] ..... A47L 13/24

[52] U.S. Cl. ..... 15/228; 15/147.2

[58] Field of Search ..... 15/147.2, 228, 15/229.6–229.9, 247

[56] References Cited

U.S. PATENT DOCUMENTS

| | | | |
|---|---|---|---|
| 1,114,163 | 10/1914 | Mansfield | 15/247 |
| 1,408,488 | 3/1922 | Toplitz | 15/247 |
| 1,475,521 | 11/1923 | Sturgis | 15/229.8 |
| 1,643,637 | 9/1927 | Chadwick | 15/228 |
| 1,675,736 | 7/1928 | Sturgis | 15/228 |
| 2,831,207 | 4/1958 | Thompson et al. | 15/228 |
| 2,858,559 | 11/1958 | Carlson, Sr. | 15/247 |
| 3,395,415 | 8/1968 | Leland | 15/229.6 |
| 3,986,225 | 10/1976 | Komatsu | 15/147.2 |
| 4,114,223 | 9/1978 | Buchanan | 15/228 |
| 5,358,107 | 10/1994 | Laske | 15/247 |

FOREIGN PATENT DOCUMENTS

| | | | |
|---|---|---|---|
| 631650 | 12/1927 | France | 15/229.6 |
| 723793 | 4/1932 | France | 15/147.2 |
| 161459 | 5/1920 | United Kingdom | 15/229.6 |

*Primary Examiner*—Mark Spisich
*Attorney, Agent, or Firm*—Cesari and McKenna

[57] ABSTRACT

A reversible mop that includes a frame formed of a solid block of material presents two supporting horizontal surfaces having a centrally mounted, pivotally attached handle. The mop is easily reversible by simply rotating the handle through an interruption in the frame block, to select one side or the other side as the floor-facing surface. In either of the orientations, the mop presents a flat surface over substantially the entire surface of the mop. This maximizes the amount of contact with the floor for better mopping action. The handle may be attached to the central pin by a releasable coupling having a central pivot. The pivot provides the user of the mop with the ability to swing the mop from left to right, thereby increasing the utility of the mop when it is applied to large surface areas.

2 Claims, 3 Drawing Sheets

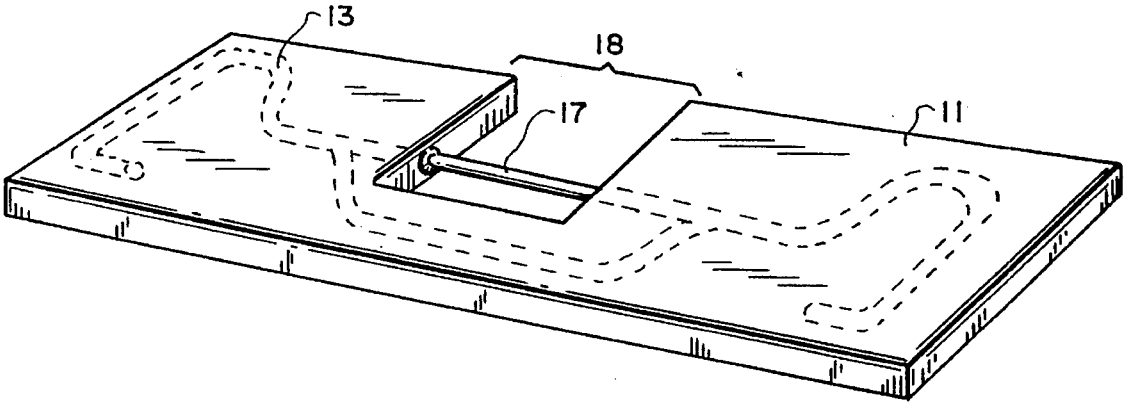
FIG. 2
FIG. 3A
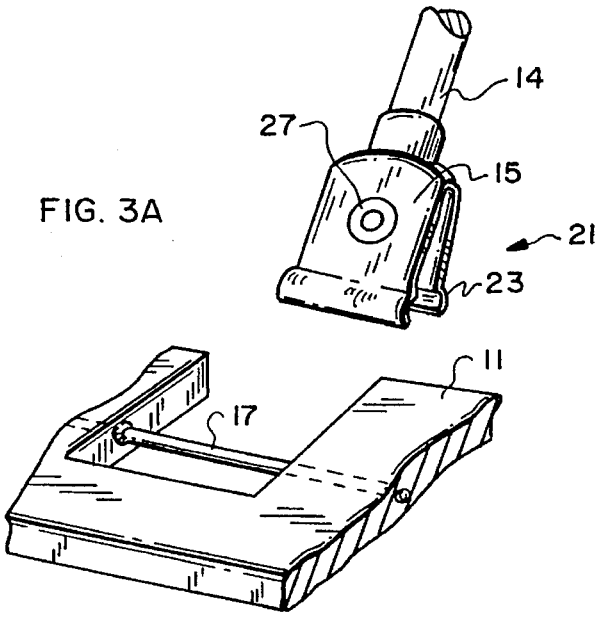
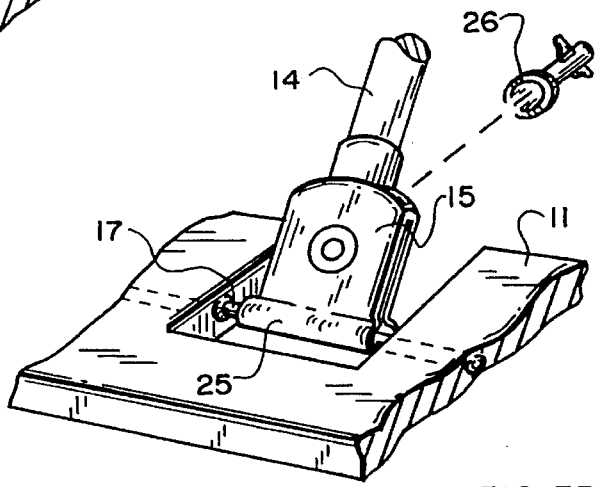
FIG. 3B

MOP INCLUDING A FRAME BLOCK HOLDER WITH A REMOVABLE TUBE-SHAPED COVER

FIELD OF THE INVENTION

This invention relates to a reversible mop which includes a frame formed of a solid block of material having an upper and lower surface, the frame including a centrally mounted, pivotally attached handle, and a tubular cover having a centrally located opening.

BACKGROUND OF THE INVENTION

Mops have been in existence for many years, and they have been designed in various ways for different uses. For example, I have previously designed a metal mop frame used with a center-mounted handle that may easily be reversed thereby permitting use one of two possible mopping surfaces. In this type of mop, one edge of the frame is provided with an interruption, to permit pivoting of the handle through the frame. This permits one to select one side of the mop or the other side as the downward-facing mopping surface.

A two-sided removable cover is used with this type of mop. So that the cover does not interfere with rotation of the handle, the cover is provided with a slot that extends from the pivotal connection of the frame to the frame edge. This arrangement provides the advantage that the mop cover may be reversed, by simply rotating the handle about the pivot, without removing the mop cover, and without the cover interfering with the handle. See the detailed description of this device in my prior U.S. Pat. No. 4,114,223, issued on Sep. 19, 1978, entitled "Mop Having a Removable Cover".

While this mop works well for its intended purpose, it is not without its shortcomings. In particular, this type of mop requires the manufacture of a relatively expensive, heavy metallic frame structure in order to support the cover, and so that the handle does not damage the frame after repeated moppings.

In addition, my prior mop has a fairly narrow interruption, which is only wide enough to permit attachment of the pivotally mounted handle. Thus, it cannot be used to cover a large area without the user stepping from side to side, that is, the user must stand basically behind or in front of the mop, since the narrow interruption for the handle does not easily permit movement of the mop from side to side.

Since my invention of the reversible mop, various other mops have been devised, such as that shown in U.S. Pat. No. 4,656,686, issued to Moss et al., and assigned to Seeco Industries, Inc. That type of mop has a frame which is formed from a molded plastic base member which has a substantially flat bottom surface.

Because this type of mop is formed of a molded plastic, it is relatively inexpensive to manufacture.

In addition, because the Moss mop has a base member with a substantially flat bottom surface, it can be used for applying uniform pressure over substantially the entire surface of the mop, to maximize the amount of surface contact with the floor for better mopping.

However, the Moss mop is not reversible, and therefore, when the mop cover becomes dirty, the cover must be removed and a new cover must always be installed.

What is needed is a mop which would avoid all of the above-mentioned shortcomings.

In particular, the mop should be easily reversible, such as by permitting the handle to be rotated through the frame from one side to the other.

The mop frame should be easy to manufacture and should provide pressure uniformly over substantially the entire surface of the cover, regardless of which side of the frame is positioned against the floor.

In addition, the mop should have a cover that is inexpensible to manufacture and be easy to install, without the need for clips, snaps or other fastening mechanisms being necessary to hold the cover in place on the mop frame.

Furthermore, it should be possible to adopt the mop frame for rapid side to side mopping movements, which would greatly improve the utility of the mop for application to large surfaces.

Finally, the handle should attach to the frame in such a way that repeated motion of the handle does not wear away or otherwise damage the frame after repeated use.

SUMMARY OF THE INVENTION

Briefly, my invention is a mop frame consisting of a generally rectangular block of material, which may, for example, be made from plastic foam or from various laminated materials. One edge of the block is provided with an interruption.

Within the space created by the interruption, a pin is laterally disposed to which various types of handle attachments may be pivotally mounted. Washers are positioned on the pin adjacent where the pin meets the frame block. This keeps the handle from chafing the block material after repeated pivoting of the frame.

A removable, generally rectangularly-shaped mop cover is also provided for the frame. The cover is arranged to have cleaning surfaces on both sides. As slot is provided in the cover, extending from a point adjacent the pivotal connection of the frame, to the interruption in the frame edge.

The mop handle may thus be rotated through the frame, by pivoting the handle through the interruption. This permits rapid selection of either one side of the cover or the other side to be used against the surface to be mopped.

At the same time, the combination of the frame and handle hold the cover in place, so that no ties, snaps, or other fasteners need to be used to hold the cover in place on the frame.

In a preferred embodiment, the cover generally defines a tube having an opening or slot along one edge. To insert the cover tube on the frame, the end portion of the frame is fed through the slot. The side edges of cover may be left open or may be secured together depending upon the intended use of the cover.

BRIEF DESCRIPTION OF THE DRAWINGS

Other objects, features and advantages of this invention will be apparent from the following detailed description of a preferred embodiment, when read together with the accompanying drawings, in which:

FIG. 2 is a more detailed view of the frame and pin assembly;

FIGS. 3A and 3B are isometric views of various type of pivots or hinges that may be used to attach the handle to the frame;

DETAILED DESCRIPTION OF A PREFERRED EMBODIMENT

Figure 1:
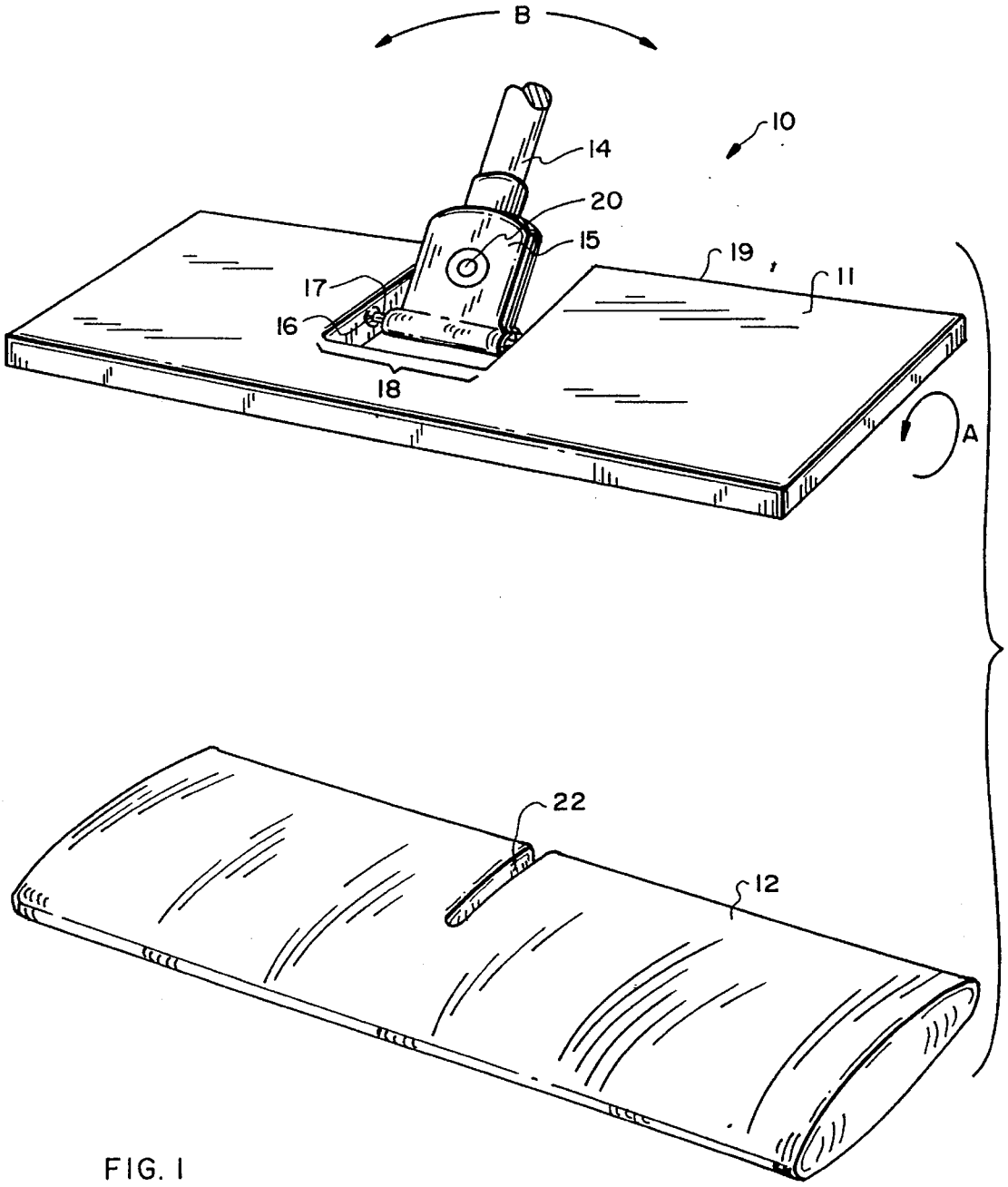
FIG. 1 is a fragmentary, exploded, isometric view of a mop frame and cover according to the invention.

Referring now in detail to the drawings, FIG. 1 shows a mop 10 in accordance with the invention. The mop 10 consists of a frame 11 and cover 12. A handle 14 is pivotally attached to a transverse pin 17 disposed in the frame 11, via a handle coupling 15. As such, one side or the other side of the frame block 11 may be chosen to be exposed as the lower floor-facing portion of the mop 10, by simply rotating the handle 14 about the pin 17, in the direction of the arrow A.

The unitary frame block 11 is typically molded of solid, flat plastic foam, or may be a lamination of one or more different materials. As shown in FIG. 1, the frame block 11 is generally rectangular in shape, although other shapes are possible.

The frame block 11 includes a pin 17 disposed therein, to which the handle 14 is pivotally attached by the coupling 15.

The pin 17 is disposed within an interruption 18 formed within the frame 11. The interruption 18 is formed along one edge, typically the rear edge 19, of the frame 11. The interruption 18 permits the handle 14 to pivot from one side of the frame 11 to the other side, without interfering with the frame 11.

In particular, the mop 10 may be used on both surfaces presented by the frame 11 without having to remove the handle. This is because the frame block pin 17 allows the coupling 15 and hence the handle 14 to swing through the interruption 18 so that either one of the sides of the frame block 11 may be selected to face the surface to be mopped. This permits either the top side shown in FIG. 1 as well as a bottom side (not shown in the drawings but parallel to the top side), to be used for mopping.

A pair of washers or collars 16 are preferably disposed on the pin 17 adjacent both sides of the interruption 18. The collars 16 help to prevent the handle from making abrasions in or otherwise causing damage to the frame block 11. This is especially true when the handle 14 is pivoted about the pin 17 from one side to the other side.

The mop cover 12 may be for any desired application of the mop 10. In the example shown in FIG. 1, the mop 10 is a fabric cover 12 consisting of a yarn sown to a backing such as that formed of vinyl or rubber. Other types of covers 12 can also be used.

The cover 12 is generally shaped as a tube. The cover has a slot 22 formed in a central portion thereof, to permit the cover 12 to be easily removed from the frame block 11 to clean or to replace the cover 12.

The slot 22 formed in the cover 12 not only allows the handle 14 to easily swing left to right in the direction of arrow B, but also easily permits the handle to be swung through the interruption 18 in the frame 11, in the direction of the arrow A, without removing the cover 12.

The cover 12 is preferably formed from a fabric which may be twisted into the desired generally tubular shape. In a typical embodiment, the cover 12 is formed of a type of yarn which is sown onto a backing, such as rubber, vinyl, or similar materials. The particular type of face yarn for the cover 12 depends upon the particular desired application for the mop. For example, the face yarn material may be synthetic or of natural fibers. The yarn selection typically depends upon whether the mop 10 is intended for dry or wet mopping, or for the spreading of particular types of finishes or sealants.

As shown best in FIG. 2, the frame block 11 is typically reinforced so that its shape is retained during prolonged use. The reinforcement may take the form of a bent or meandering wire or rod 13 which is disposed within the block 11. In such an instance, the pin 17 is embodied as a middle section of the wire 13, that is, the section of the wire 13 which is exposed by the interruption 18 in the frame block 11.

Returning to FIG. 1, the coupling 15 preferably includes a central pivot 20. The pivot 20 also serves as an anchor point for the handle 14 within a central portion of the coupling 15. The pivot 20 allows the handle 14 to swing along an axis parallel to the major axis of the block, such as indicated by arrow B. The pivot 20 thus allows the user to use the handle 14 to not only push the mop in a forward and backward direction, but also in a left to right motion, in the direction of arrow B. This movement is provided without removing the cleaning cover tube 12, or without adjusting the handle 14, thereby permitting easier coverage of a large area such as when an entire room is being mopped.

After installation of the cover 12 onto the frame 11, the handle 14 is attached to the frame 11 by securing the handle 14 onto the pin 17.

The handle 14 thus also serves to keep the cover 12 in place, since it protrudes through the slot 22 in the cover 12. This greatly assists in increasing the speed within which the cover 12 may be attached to the frame 11, since clips, snaps, or other fastening arrangements do not need to be provided to hold the cover 12 onto the frame 11.

The handle 14 may attach to the pin 17 in various ways, as shown in FIGS. 3A and 3B. In FIG. 3A, the coupling 15 consists of a spring clip 21, having a pair of lower jaws 23, and the handle 14 is secured to the clip 21 with a fastener 27 such as a nut. To attach the handle 14 to the frame 11, the jaws 23 of the clip are opened, and then aligned and closed about the pin 17. This then firmly seats the handle 14 in place on the frame 11.

Alternatively, as shown in FIG. 3B, the coupling 15 may consist of a closed bottom cylindrical portion 25 much like a hinge, which is slipped around the pin 17. A clevis pin 26 is then used to hold the handle 14 in place in the upper portion of the coupling 15.

Figure 4:
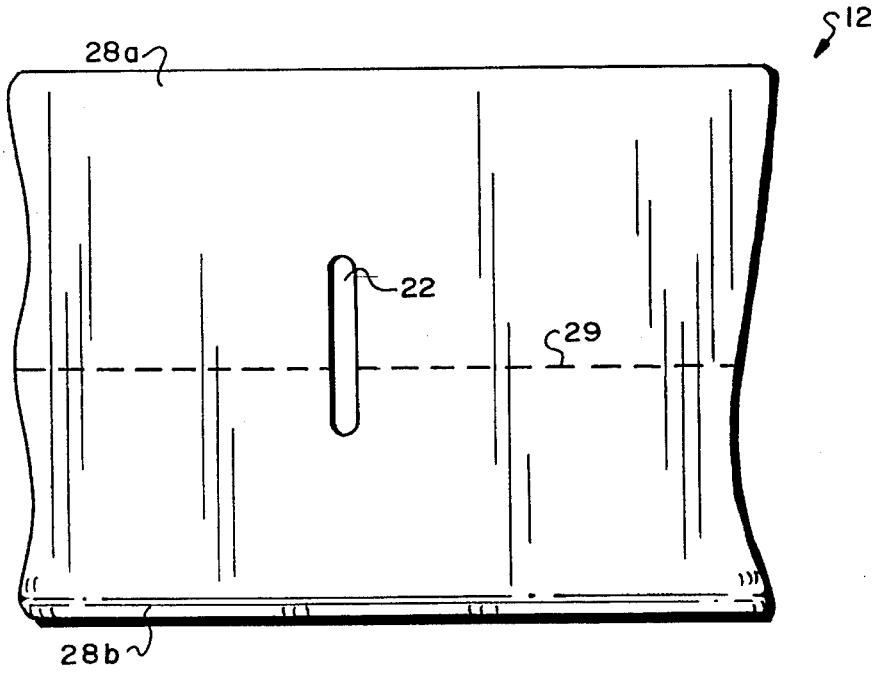
FIG. 4 is a plan view of the mop cover prior to its stitching in finished form.
Figure 5:
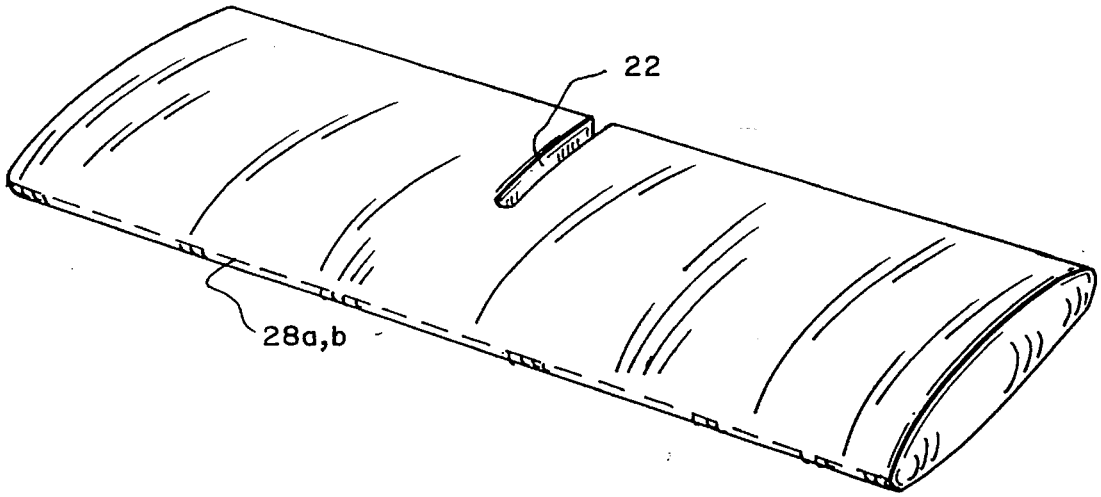
FIG. 5 is an isometric view of the mop cover showing where a stitch is made to form the tube.

FIG. 4 is a plan view of the mop cover 12 prior to its finished form. In one embodiment, the slot 22 is formed in the center of the material and then a fold is made along a transverse line 29, also in approximately in the center of the material. The cover material is then joined along the transverse edges 28*a* and 28*b*, such as with a stitch made along the adjoined edges 28*a* and 28*b* as shown in FIG. 5.

The edges 28*a* and 28*b* can be joined using other methods such as by gluing, or the material itself can be woven into a tube shape initially.

The cover 12 thus defines a tube having a mopping surface on each side thereof, and the slot 22 is thus provided from the center of the cover 12 to the respective edge thereof.

A number of advantages can thus be seen with a mop design according to the present invention. In particular, the mop's design allows the cover 12 to lay flat and firmly on the surface to be mopped, while at the same time providing the advantage of providing two mopping surfaces which may be quickly selected, by simply rotating the handle 14 through the interruption in the frame block 11.

In addition, the mop 10 can be swung from side to side, so that when attempting to cover a large area such as the floor of a large room, the handle assembly acts as a pivot for the handle to support the required side to side motions.

The cover 12 is easy to remove from the frame 11 without the need to use ties, snaps or other fasteners to hold the cover 12 in place.

The frame block 11 provides a flat surface in both orientations, which allows the mop to always lay flat against the surface to be mopped. This maximizes the contact area of the cleaning cover and the surface.

Other embodiments of this invention will occur with those of skill in the art which are within the scope of the following claims.

What is claimed is:

1. A mop consisting of a frame member and a removable mop cover, the mop having a handle pivotally mounted centrally within the frame member, and the handle adapted for movement from a first side to a second side of said frame, said cover comprising a rectangular piece of material folded about a midpoint thereof so as to define two substantially identical rectangular halves each having an outer edge substantially parallel to the fold, said material having a slot formed in a central portion thereof in both said halves wherein the slot is generally symmetrical about said fold to permit insertion of said frame therein, said outer edges are joined to one another to form an integral fold of cover material, said outer edges being permanently secured together substantially along their entire extent, and said slot being adapted to permit said mop handle to extend therethrough when said handle is rotated from said first side of said frame to said second side thereof, and wherein said frame member is composed of a solid block of material thereby permitting the cover to lay flat against a surface to be cleaned by maximizing the cleaning effect, and said frame member having flat top and bottom surfaces for applying uniform pressure over substantially the entire surface of the cover.

2. A mop consisting of a frame comprising a solid elongated block of material, a handle, and a mop cover of a generally tubular shape design, such that the cover may be installed and removed from the frame block without using any additional securing mechanism, the frame having both a first and second surface, each of the first and second surfaces having a major axis extending along the length of the block, and each of the first and second surfaces having a minor axis disposed perpendicularly to the respective major axis, the frame block also having an interruption formed in a central portion thereof in parallel with the minor axes of both the first and second surfaces, the frame block also having a pin disposed within the interruption in parallel with the major axes of both the first and second surfaces, with a coupling being disposed on the handle and the coupling engaging the pin and thereby connecting the handle to the frame, the interruption in the frame being of a size and shape which is large enough to permit passage of said handle therethrough while the handle is connected to the frame, and the coupling permitting rotation of the handle about the pin, to permit selection of either the first or second surface to be placed adjacent a surface to be mopped, and the coupling also permitting movement of the handle relative to the frame block such that the handle may be swung not only in a direction in parallel with the major axis of the frame block, but also in a direction in parallel with the minor axis of the frame block, so that the mop may be used to clean with a side to side sweeping motion.

* * * * *